United States Patent [19]

Wessman

[11] 4,061,012

[45] Dec. 6, 1977

[54] DRAWING AND IRONING MACHINE WITH POSITIVE CUP FEEDER

[75] Inventor: Elbert F. Wessman, New Lenox, Ill.

[73] Assignee: National Can Corporation, Chicago, Ill.

[21] Appl. No.: 708,230

[22] Filed: July 23, 1976

[51] Int. Cl.[2] ..... B21D 22/00

[52] U.S. Cl. ..... 72/347; 72/361; 72/424; 113/26; 113/115

[58] Field of Search ..... 72/356, 361, 349, 424, 72/347; 113/26, 115, 113 D, 120 P

[56] References Cited

U.S. PATENT DOCUMENTS

| | | | |
|---|---|---|---|
| 518,105 | 4/1894 | Jensen | 113/26 |
| 3,422,657 | 1/1969 | Grombka | 72/424 X |
| 3,628,368 | 12/1971 | Duss et al. | 72/424 |

*Primary Examiner*—Leon Gilden

*Attorney, Agent, or Firm*—Robert A. Stenzel; Ralph R. Rath

[57] ABSTRACT

Cup feeding means for feeding cups to a drawing and ironing machine having a generally elongated horizontal opening defined by ironing rings and a ram axially aligned with said opening is disclosed herein. The cup feeding mechanism consists of guide means for continuously supplying cups to a station adjacent the opening and an arm pivoted below the guide means and the opening. The arm has an arcuate surface for receiving cups from the guide means and is driven between first and second positions for moving the cups from the guide means into alignment with the opening of the drawing and ironing machine. The cup feeding means also includes stop means located adjacent the opening with the stop means also having an arcuate surface that generally defines an extension of the arcuate surface on the arm so that the cups are positively gripped between the arcuate surfaces when the arm is moved to the second position.

6 Claims, 2 Drawing Figures

DRAWING AND IRONING MACHINE WITH POSITIVE CUP FEEDER

BACKGROUND OF THE INVENTION

This invention relates generally to drawing and ironing machines and more particularly to a positive cup feeding mechanism for taking cups from a continuous supply and locating them in a particular position with respect to the drawing and ironing machine.

In recent years, a two-piece container has received a remarkable degree of commercial acceptance. A two-piece container consists of an integral bottom wall and sidewall of a container which has an end attached thereto to form the finished container. In the formation of such containers, it has been customary to take a circular blank of stock material that is first deformed into a shallow cup. This cup is the placed into a drawing and ironing machine which consist of a plurality of axially spaced rings defining an elongated opening and a ram or punch which cooperates with the ring to deform the cup into a container having a genrally cylindrical sidewall and a bottom wall of a particular configuration.

One type of machine that has found commercial acceptance for producing a container from a cup is marketed by Ragsdale Bros., Inc. of Englewood, Colorado under Model No. CR-24 or CR-265. These body makers or drawing and ironing presses are what are generally referred to as horizontal positive can wall drawing and ironing presses.

The Ragsdale presses generally incorporate what is known as a "gravity-feed" for the cups to the opening for the press. Difficulties have been encountered in such a "gravity-feed" arrangement in that it is difficult to accurately align the cups between the punch and the ironing rings. Furthermore, gravity feeding has an inherent drawback in that the speed of operation is of necessity limited to a large measure by the speed at which the cups can be gravity fed to the drawing and ironing machine.

SUMMARY OF THE INVENTION

According to the present invention, there is provided an improved positive feeding mechanism for feeding cups to a drawing and ironing machine that transforms the cups into cylindrical containers having an integral end wall. The cup feeding mechanism or means consists of a guide chute for receiving a continuous supply of cups that are gravity fed to a station adjacent an opening in the drawing and ironing machine. An arm is pivoted below the end of the guide chute and the opening and has an arcuate surface conforming generally to the periphery of the cup. The arm is pivoted between first and second positions by drive means with the arcuate surface respectively aligned with the lower end of the guide chute and the opening in the drawing and ironing machine in the respective positions. Thus, movement of the arm from the first to the second position positively transfers cups from the guide chute into alignment with the opening in the drawing and ironing machine so that the cup can be picked up by a ram or punch and drawn and ironed through the cooperation with the ironing rings axially spaced within the opening.

According to one aspect of the invention, the feeding mechanism also incorporates stop means adjacent the opening in the drawing and ironing machine with the stop means having an arcuate surface that is generally opposed to the arcuate surface on the arm and defines a continuation thereof when the arm is in the second position so that the cups are gripped between the arcuate surfaces. Also, the arm is moved between first and second positions by the same drive mechanism that drives the remainder of the components of the drawing and ironing machine so that the arm is moved in synchronized relation with the ram or punch.

In its specific embodiment, the drive means consists of a continuously rotating cam and a follower reciprocated between first and second positions by the cam with an adjustable link between the follower and the arm.

DETAILED DESCRIPTION

Figure 1:
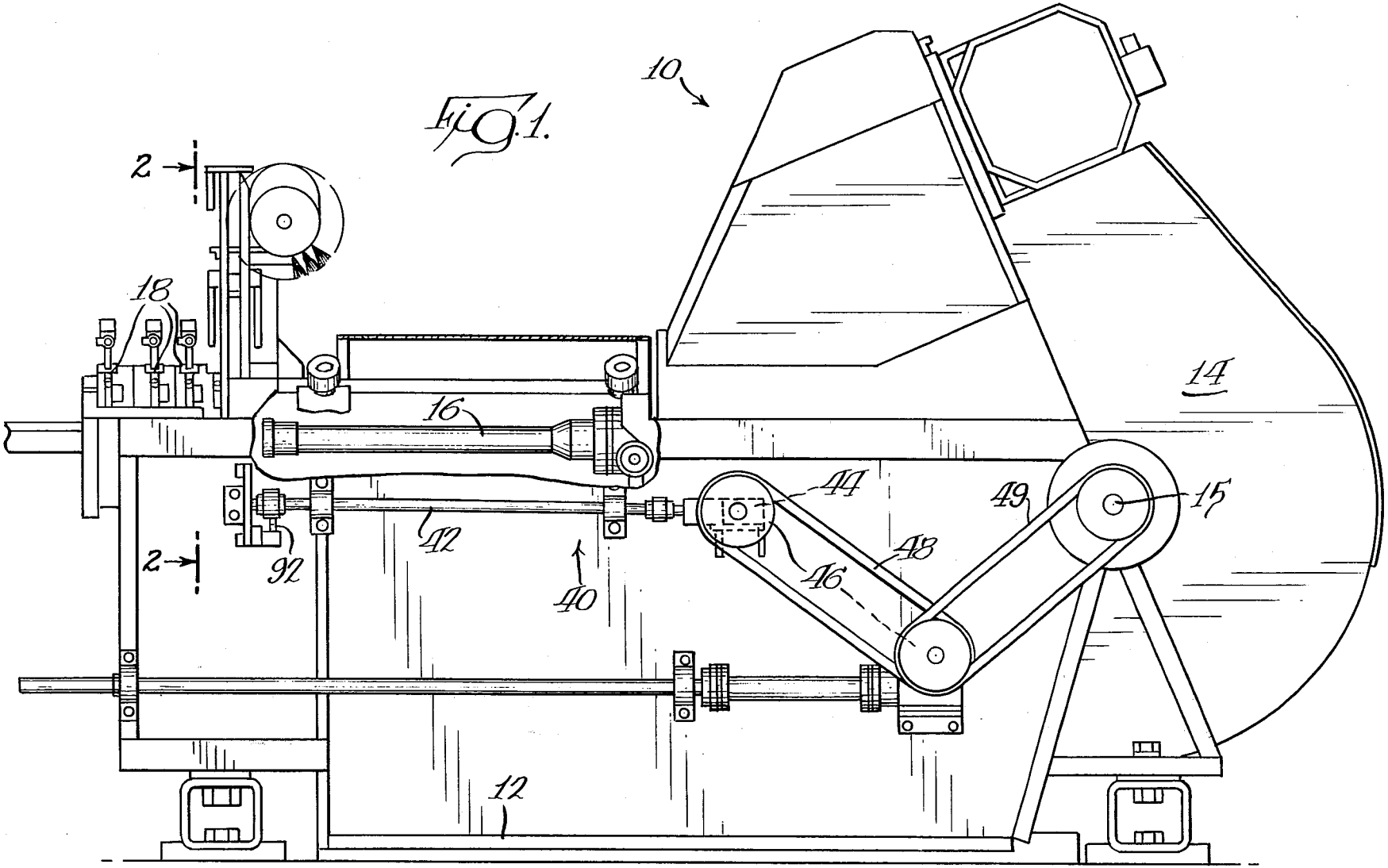
FIG. 1 of the drawings generally shows a horizontal side elevational view of a drawing and ironing machine having the present invention incorporated therein.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings generally discloses a drawing and ironing machine indicated by the reference numeral 10. The illustrated drawing and ironing machine in a Model CR-24 or CR-265 can wall drawing and ironing press or body maker that is manufactured by Ragsdale Bros., Inc. of Englewood, Colorado. The body maker includes a frame structure 12 that supports a drive motor 14 which drives all of the moving components of the body maker through a drive shaft 15 having a flywheel and a crank for driving ram or punch 16.

The drawing and ironing machine 10 also incorporates a tool pack which includes a plurality of axially spaced ironing rings 18 that define an opening 19 aligned with ram or punch 16. Since the remaining details of the drawing and ironing machine do not form part of the present invention, no detailed description thereof appears to be necessary.

Figure 2:
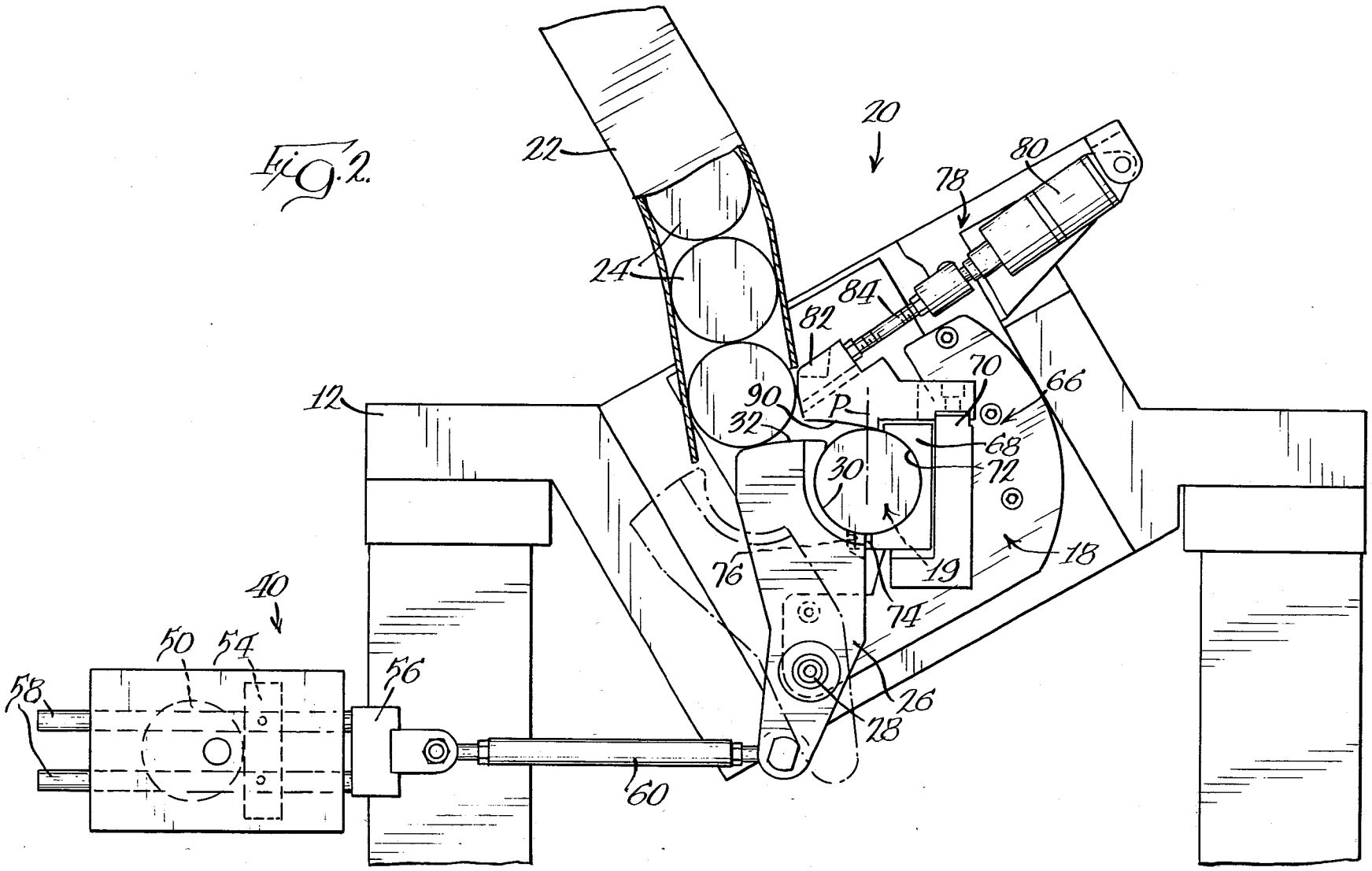
FIG. 2 is a fragmentary cross-sectional view as viewed generally along lines 2—2 of FIG. 1 showing the details of the present invention.

According to the present invention, a positive cup feeding mechanism generally designated by the reference numeral 20 for continuously axially aligning cups with the opening defined by the ironing rings 18 so that the ram or puch will be accurately aligned with the cups for the drawing and ironing operation. The details of the cup feeding means 20 are illustrated in FIG. 2 and include a guide chute means 22 for receiving a continuous supply of cups 24. Guide chute means 22 extends generally vertically adjacent opening 19 and has a lower open end that is located adjacent but axially offset from opening 19. Cup feeding means 20 includes an arm 26 that is pivoted on a pin or bolt 28 intermediate opposite ends thereof on the frame 12 of body maker 10. Arm 26 has a generally arcuate surface 30 circumscribing an arc of more than 90 degrees and the arcuate surface has a configuration that conforms generally to the periphery of cups 24. The upper end of arm 26 has a generally flat blocking surface 32 which extends across the lower open end of guide chute 22 when the arm is in the second position illustrated in solid lines in FIG. 2.

The lower or opposite end of arm 26 is connected to shaft 15 through connection means 40 illustrated in FIGS. 1 and 2. Connection means 40 includes a shaft 42 that has a right angle gear box 44 on one end thereof with gear box 44 being connected to eccentric shaft 15 through a pair of sprockets 46 and drive belts 48 and 49. The opposite end of shft 42 has a linear stroking cam 50 secured thereto and cam 50 is continuously rotated adjacent a support block 54. Support block 54 supports a follower 56 that is supported on support block 54 through a pair of guide rods 58 and follower 56 is positively moved between positions by rotation of cam 50. The follower or follower means 56 is connected to the lower end of arm 26 through an adjustable link 60 so that the position of the arcuate surface 30 can be accurately aligned with the periphery of opening 19.

According to the further aspect of the invention, cup feeding means 20 also incorporates stop means 66 that cooperates with arm 26 to accurately position cups 24 in axial alignment with opening 19. Stop means 66 consists of a member 68 that is supported by bracket 70 adjacent opening 19. Member 68 has a generally arcuate surface 72 that circumscribes an arc of approximately but slightly less than 180°. This arcuate surface 72 again conforms generally to the configuration of the periphery of cups 24 and is positioned generally opposite arcuate surface 30 when the arm is in the second position illustrated in solid lines in FIG. 2. One major advantage of stop means 66 is that by proper adjustment of link 60, arcuate surfaces 30 and 72 are positioned so that cup 24 is gripped between these two surfaces. In fact, if desired, link 60 can be adjusted so that a slight pressure is created on the cup 24 when arm 26 is in the second position so that the cup will be rounded out to insure easy entrance of the punch or ram 16 into the cup.

Member 68 also has a lip or extension 74 at the lower end of arcuate surface which extends past a vertical plane P through the center of opening 19 and this lip is received into a recess 76 on arm 26 when the arm is in a closed position. Thus, after the cup is moved into alignment with opening 19, the cup will remain in position without the aid of arm 26. A further blocking means 78 is also preferably incorporated into the cup feed mechanism 20. Blocking means 78 consists of a fluid ram 80 having a stop element 82 secured to the end of piston rod 84. Thus, stop element 82 can be moved from the illustrated position to a second position wherein the lowermost cup 24 is held within guide chute 22 so that arm 26 can be reciprocated between first and second position without feeding cups to the machine.

The present invention has numerous advantages over existing known gravity feed or linear stroking methods of feeding cups to a drawing and ironing machine or body maker. One of the primary advantages of the present invention is that the cup feeding mechanism can readily be incorporated into an existing machine without any major rework of the completed machine. It is only necessary for minor rework of the existing machine to incorporate the feeding mechanism. Furthermore, the positive feeding of the cup in the manner described above, allow more time for the cup to be aligned with the ram or punch to insure proper positioning of the cup. Preferably, the cam configuration is such that the arm 26 is in the dotted line first position for approximately 60° of rotation of cam 50. During the next 60°, the arm is moved from the dotted line to the solid line position so that the cup is then in the position for pick up and is gripped between arcuate surfaces 30 and 72. During the next 180° of rotation, arm 26 remains in the second solid line or cup pickup position and during the last 60° of rotation of cam 50, arm 26 is moved from the second solid line position to the first dotted line position for receiving another cup.

It should be noted that while the cup is not positively gripped while being moved from the chute 22 into alignment with opening 19, the speed at which the operation takes place results in effectively having proper control of the cup at all times. This is further assured by having a guide surface 90 defining an extension of the upper end of arcuate surface 72 on member 68.

Another advantage of the present invention is that the arm 26 is pivoted between first and second positions by the same drive means which operates all of the remainder of the body maker 10. This insures a synchronized movement of the arm with respect to the ram or punch 16 and considerably reduces the cost of the feed mechanism.

Actual use has shown that the cup feeding mechanism of the present invention substantially reduces the maintenance of the punch since misalignment of the cups with the punch occurs very seldom. If desired, an overload protection limit switch 92 may be incorporated to shut off the equipment if there is an improper feeding of the cups. This switch is actuated by a pin (not shown) when the cam unit including cam 50 and follower means 52, 54, 56 reach an overload condition and thereby prevent damage to the cam unit, should a jam occur.

What is claimed is:

1. In a drawing and ironing machine having an elongated, generally horizontal opening with ironing rings surrounding said opening at axially spaced locations along said opening, a ram axially aligned with said opening and cooperating with said iron rings for drawing and ironing a cup into a container sidewall and end wall, and cup feeding means for feeding cups to said machine, the improvement of said cup feeding means comprising guide means for receiving a continuous supply of cups, said guide means extending generally vertically adjacent said opening having a lower open end, an arm pivoted intermediate opposite ends thereof about a fixed axis below said open end of said opening, said arm having an arcuate surface on one end thereof conforming generally to the periphery of said cups, drive means connected to an opposite end of said arm for pivoting said arm between first and second positions with said arcuate surface aligned with said open end in said first position and with said opening in said second position so that said cups are positively moved along an arcuate path from said guide means to said opening, stop means located adjacent said opening for arresting movement of said cups and cooperating with the arcuate surface on said arm to align said cups with said opening, and said stop means having an arcuate surface generally opposed to said arcuate surface on said arm and defining an uninterrupted continuation thereof when said arm is in said second position so that said cups are gripped between said arcuate surfaces when said arm is in said second position with sufficient pressure so that out of round cups will be rounded out by the cooperative action of said arcuate surfaces.

2. A drawing and ironing machine as defined in claim 1, in which said arm has a blocking surface extending across said open end in said second position.

3. A drawing and ironing machine as defined in claim 2, further including a blocking member movable into the path of movement of said cups into said chute so that said arm can be moved between positions without feeding cups.

4. A drawing and ironing machine as defined in claim 1, in which said drive means includes a drive motor for operating said machine and connection means between said drive motor and said arm for moving said arm in synchronized relation with said ram.

5. A drawing and ironing machine as defined in claim 4, in which said connection means includes a cam driven by said drive motor, cam follower means cooperating with said cam, and an adjustable link connecting said follower means to said arm.

6. A drawing and ironing machine as defined in claim 1, in which said stop means has an extension extending from a lower end of said arcuate surface on said stop means, said extension extending beyond a vertical plan passing through a center of said opening to act as a support for said cup.

* * * * *

UNITED STATES PATENT AND TRADEMARK OFFICE

CERTIFICATE OF CORRECTION

PATENT NO. : 4,061,012

DATED : December 6, 1977

INVENTOR(S) : Elbert F. Wessman

It is certified that error appears in the above-identified patent and that said Letters Patent are hereby corrected as shown below:

Column 1, line 18, "the" should read --then--.
Column 1, line 19, "consist" should read --consists--.
Column 1, line 22, "genrally" should read --generally--.
Column 2, line 35, "in" should read --is--.
Column 2, line 54, "puch" should read --punch--.
Column 3, line 9, "shft" should read --shaft--.
Column 3, line 46, "feed" should read --feeding--.
Column 3, line 64, "allow" should read --allows--.
Column 4, line 40, "iron" should read --ironing--.
Column 4, line 46, after "opening" insert --and--.
Column 5, line 6, "into" should read --in--.
Column 6, line 11, "plan" should read --plane--.

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*